US008840431B2

(12) United States Patent
Nguyen et al.

(10) Patent No.: US 8,840,431 B2
(45) Date of Patent: Sep. 23, 2014

(54) ELECTRICAL CONNECTOR SYSTEMS

(71) Applicant: Tyco Electronics Corporation, Berwyn, PA (US)

(72) Inventors: Hung Thai Nguyen, Harrisburg, PA (US); Keith Edwin Miller, Manheim, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 56 days.

(21) Appl. No.: 13/662,094

(22) Filed: Oct. 26, 2012

(65) Prior Publication Data

US 2014/0120770 A1 May 1, 2014

(51) Int. Cl.
*H01R 13/648* (2006.01)

(52) U.S. Cl.
USPC ..... 439/607.34

(58) Field of Classification Search
CPC ..... H01R 13/6463; H01R 13/6585; H01R 13/6587; H01R 23/6873; H01R 33/7628; H01R 23/688; H01R 12/724; H01R 13/65802
USPC ..... 439/607.34, 607.01, 607.07, 607.1, 439/607.11, 701, 61, 95, 108, 79, 101
See application file for complete search history.

(56) References Cited

U.S. PATENT DOCUMENTS

| | | | | |
|---|---|---|---|---|
| 6,323,430 | B1 | 11/2001 | Finona | |
| 6,527,587 | B1 * | 3/2003 | Ortega et al. | 439/607.05 |
| 7,806,729 | B2 * | 10/2010 | Nguyen et al. | 439/607.23 |
| 7,997,934 | B2 * | 8/2011 | Bixler et al. | 439/607.05 |
| 2006/0024984 | A1 | 2/2006 | Cohen et al. | |
| 2009/0203259 | A1 | 8/2009 | Nguyen et al. | |

FOREIGN PATENT DOCUMENTS

| | | | |
|---|---|---|---|
| DE | 10 2005 057905 | A1 | 6/2006 |
| DE | 20 2012 007577 | U1 | 9/2012 |
| EP | 1 263 091 | A2 | 12/2002 |
| EP | 2 207 244 | A2 | 7/2010 |
| JP | 2004 134312 | A | 4/2004 |
| WO | 2011 029428 | A1 | 3/2011 |

OTHER PUBLICATIONS

International Search Report, International Application No. PCT/US2013/066535, International Filing Date, Oct. 24, 2013.

* cited by examiner

*Primary Examiner* — Edwin A. Leon

(57) ABSTRACT

An electrical connector system includes a backplane connector having a housing, signal contacts held by the housing and shield plates held by the housing. The housing includes a front and a rear. The housing includes signal channels extending along mating axes thereof between the front and the rear. The signal channels receive corresponding signal contacts. The housing includes slots that receive the shield plates. The signal contacts extend along the mating axes and are arranged in pairs carrying differential signals. The shield plates are electrically conductive and extend generally parallel to the mating axes between corresponding pairs of signal contacts to entirely peripherally surround the pairs of signal contacts to provide electrical shielding for the pairs of signal contacts.

20 Claims, 6 Drawing Sheets

ELECTRICAL CONNECTOR SYSTEMS

BACKGROUND OF THE INVENTION

The subject matter herein relates generally to electrical connector systems.

Connector systems, such as backplane connector systems, are typically used to connect a one printed circuit board, such as a backplane circuit board, in parallel (perpendicular) with another printed circuit board, such as a daughtercard circuit board. As the size of electronic components is reduced and electronic components generally become more complex, it is often desirable to fit more components in less space on a circuit board or other substrate. Consequently, it has become desirable to reduce the spacing between electrical contacts within backplane connector systems and to increase the number of electrical contacts housed within backplane connector systems. Accordingly, it is desirable to develop backplane connector systems capable of operating at increased speeds, while also increasing the number of electrical contacts housed within the backplane connector system.

At increased speeds, problems arise with signal degradation, such as from cross talk between electrical contacts within the backplane connector systems. Electrical shielding is typically provided in the form of ground contacts interspersed between the signal contacts, however such systems have limited success, particularly at higher speeds.

A need remains for a backplane connector system having improved electrical shielding and performance.

BRIEF DESCRIPTION OF THE INVENTION

In one embodiment, an electrical connector system is provided including a backplane connector having a housing, signal contacts held by the housing and shield plates held by the housing. The housing includes a front and a rear. The housing includes signal channels extending along mating axes thereof between the front and the rear. The signal channels receive corresponding signal contacts. The housing includes slots that receive the shield plates. The signal contacts extend along the mating axes and are arranged in pairs carrying differential signals. The shield plates are electrically conductive and extend generally parallel to the mating axes between corresponding pairs of signal contacts to entirely peripherally surround the pairs of signal contacts to provide electrical shielding for the pairs of signal contacts.

Optionally, the signal contacts may extend lengths within the signal channels with the shield plates entirely surrounding the pairs of signal contacts along the entire lengths of the signal contacts. The shield plates may form prism shaped cavities entirely peripherally surrounding corresponding pairs of signal contacts. Each shield plate may surround more than one pair of signal contacts. The shield plates may engage at least two other shield plates.

In another embodiment, an electrical connector system is provided having a backplane connector including a housing, signal contacts held by the housing and shield plates held by the housing. The housing includes a front and a rear and opposite first and second sides extending between the front and the rear. The signal contacts are arranged in pairs carrying differential signals arranged in columns parallel to the first and second sides. The shield plates are electrically conductive. The shield plates have a wavy configuration between a first edge and a second edge. The shield plates extend between the first and second edges generally along the columns of the signal contacts such that the shield plates provide electrical shielding between pairs of the signal contacts. The shield plates are arranged in the housing such that the shield plates entirely peripherally surround the pairs of signal contacts to provide electrical shielding for the pairs of signal contacts.

In a further embodiment, an electrical connector system is provided including a backplane connector having a housing, signal contacts held by the housing and shield plates held by the housing. The housing includes a front and a rear and opposite first and second sides extending between the front and the rear. The signal contacts are arranged in pairs carrying differential signals. The pairs of signal contacts are arranged in columns generally parallel to the first and second sides. The pairs of signal contacts are arranged in rows generally perpendicular to the first and second sides. The shield plates are electrically conductive and extend between columns of the pairs of signal contacts and between rows of the pairs of signal contacts such that the shield plates entirely peripherally surround the pairs of signal contacts to provide electrical shielding for the pairs of signal contacts.

DETAILED DESCRIPTION OF THE INVENTION

Figure 1:
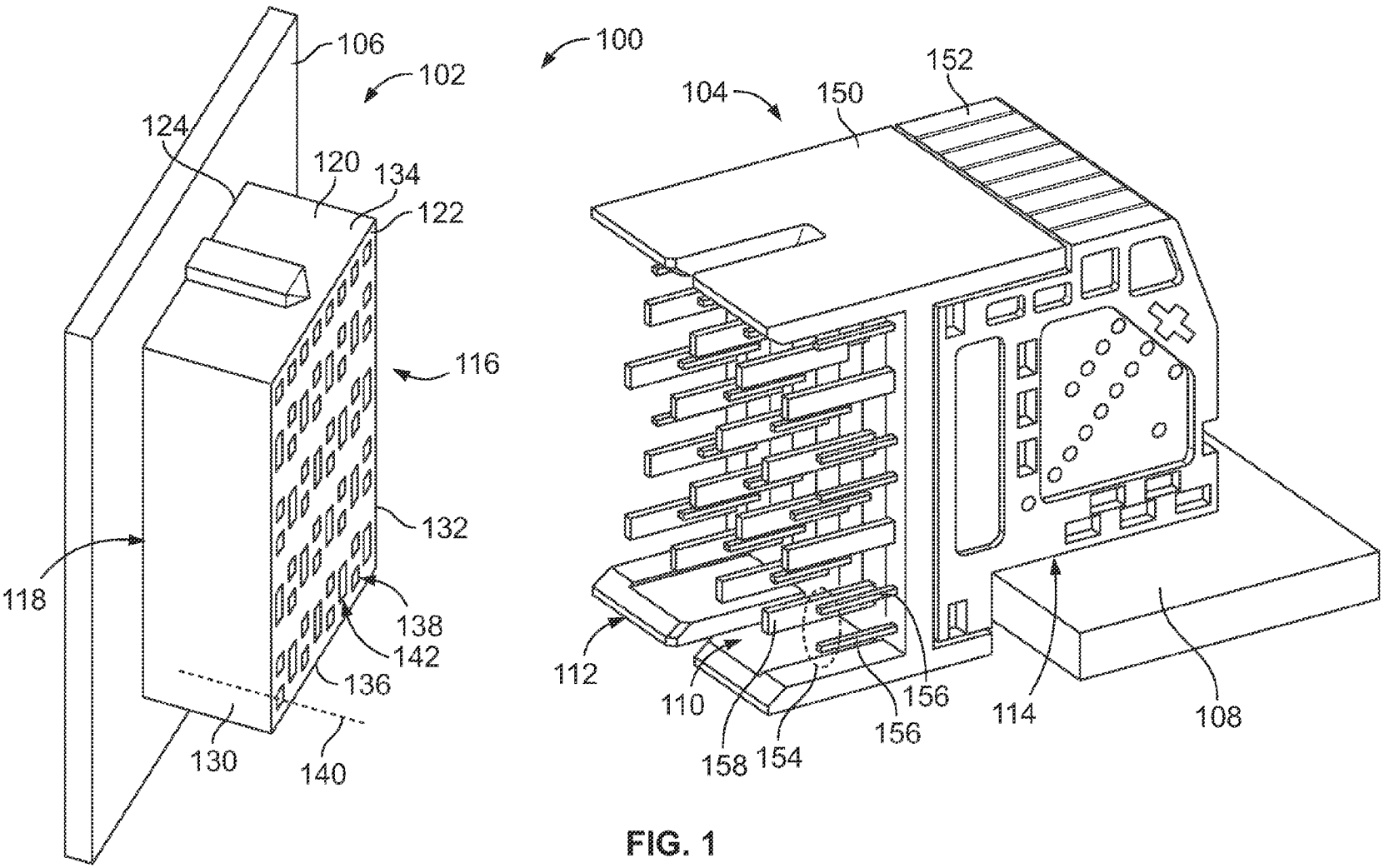
FIG. 1 illustrates an electrical connector system formed in accordance with an exemplary embodiment.

FIG. 1 illustrates an electrical connector system 100 formed in accordance with an exemplary embodiment. The electrical connector system 100 includes a backplane connector 102 and a daughtercard connector 104 that are used to electrically connect a backplane circuit board 106 and a daughtercard circuit board 108. While the electrical connector system 100 is described herein with reference to backplane connectors 102 and daughtercard connectors 104, it is realized that the subject matter herein may be utilized with different types of electrical connectors other than a backplane connector or a daughtercard connector. The backplane connector 102 and the daughtercard connector 104 are merely illustrative of an exemplary embodiment of an electrical connector system 100 that interconnects a particular type of circuit board, namely a backplane circuit board, with a daughtercard circuit board.

In alternative embodiments, other types of electrical connectors may be utilized. The electrical connectors may be used to electrically connect other types of circuit boards, other than backplane and daughtercard circuit boards. In other alternative embodiments, rather than having board mounted electrical connectors, the electrical connector system 100 may be utilized with one or more cable mounted connectors.

In the illustrated embodiment, the backplane connector 102 constitutes a header connector mounted to the backplane circuit board 106. The backplane connector 102 is received in a chamber 110 of the daughtercard connector 104 when mated. When the connectors 102, 104 are mated, the daughtercard circuit board 108 is oriented generally perpendicular with respect to the backplane circuit board 106.

The daughtercard connector 104 constitutes a right angle connector wherein a mating interface 112 and mounting interface 114 of the daughtercard connector 104 are oriented perpendicular to one another. The daughtercard connector 104 is mounted to the daughtercard circuit board 108 at the mounting interface 114. Other orientations of the interfaces 112, 114 are possible in alternative embodiments.

The backplane connector 102 includes a mating interface 116 and a mounting interface 118 that are oriented generally parallel to one another. The backplane connector 102 is mounted to the backplane circuit board 106 at the mounting interface 118. Other orientations of the interfaces 116, 118 are possible in alternative embodiments.

The backplane connector 102 includes a housing 120. The housing 120 has a mating end 122, also referred to herein as a front 122, that is loaded into the chamber 110 during mating. The housing 120 has a mounting end 124, also referred to herein as a rear 124, which is mounted to the backplane circuit board 106. The housing 120 holds a plurality of individual signal contacts 126 (shown in FIG. 3) that extend between the mating interface 116 and the mounting interface 118. In an exemplary embodiment, the signal contacts 126 are arranged in pairs carrying differential signals. The housing 120 holds a plurality of shield plates 128 (shown in FIG. 3) that extend between the mating interface 116 and the mounting interface 118.

The housing 120 includes opposite first and second sides 130, 132 and opposite first and second ends 134, 136. The backplane connector 102 may be oriented such that the first and second ends 134, 136 define a top and a bottom of the housing 120. Other orientations are possible, such as an orientation where the first and second sides 130, 132 define the top and bottom or where the front 122 and rear 124 define the top and bottom of the housing 120.

The housing 120 includes a plurality of signal channels 138 extending between the front 122 and the rear 124. The signal channels 138 extend along mating axes 140 and receive the signal contacts 126. When the backplane connector 102 and daughtercard connector 104 are mated, mating contacts 156 of the daughtercard connector 104 are also received in the signal channels 138.

The housing 120 includes slots (not shown) that receive the shield plates 128. The slots are sized and shaped to receive the shield plates 128. The housing 120 includes a plurality of ground channels 142 extending between the front 122 and the rear 124. The ground channels 142 are open to the slots. The ground channels provide access to the shield plates 128 held in the slots. The ground channels 142 and slots extend along the mating axes 140 and receive portions of the shield plates 128. When the backplane connector 102 and daughtercard connector 104 are mated, ground contacts 158 of the daughtercard connector 104 are also received in the ground channels 142. Any number of ground channels 142 may be provided. The ground channels 142 may be provided at any locations within the housing 120. In an exemplary embodiment, the ground channels 142 are generally positioned between pairs of signal channels 138, to correspond to positions of the shield plates 128 and ground contacts 158 between pairs of the signal contacts 126 and mating contacts 156. For example, the ground channels 142 may be aligned in rows and in columns with the signal channels 138. The columns may be generally parallel to the sides 130, 132 and the rows may be generally perpendicular to the sides 130, 132.

The daughtercard connector 104 includes a housing 150 holding a plurality of contact modules 152 therein. The contact modules 152 hold pairs 154 of individual mating contacts 156 that extend between the mating interface 112 and the mounting interface 114. The mating contacts 156 are configured to be mated with and electrically connected to the signal contacts 126 of the backplane connector 102. The contact modules 152 hold the individual ground contacts 158 that extend between the mating interface 112 and the mounting interface 114. The ground contacts 158 are configured to be mated with, and electrically connected to, the shield plates 128 of the backplane connector 102.

As described in further detail below, the shield plates 128 entirely peripherally surround the pairs of signal contacts 126 to provide electrical shielding for the pairs of signal contacts 126. In an exemplary embodiment, entire, 360° shielding is provided by the shield plates 128 along the length of the signal contacts 126. The shield plates 128 surround portions of the mating contacts 156 when the connectors 102, 104 are mated. The shield plates 128 provide shielding along the entire mating interface with the mating contacts 156. The shield plates 128 may control electrical characteristics at the mating interfaces 112, 116, such as by controlling cross talk, signal radiation or other electrical characteristics.

Figure 2:
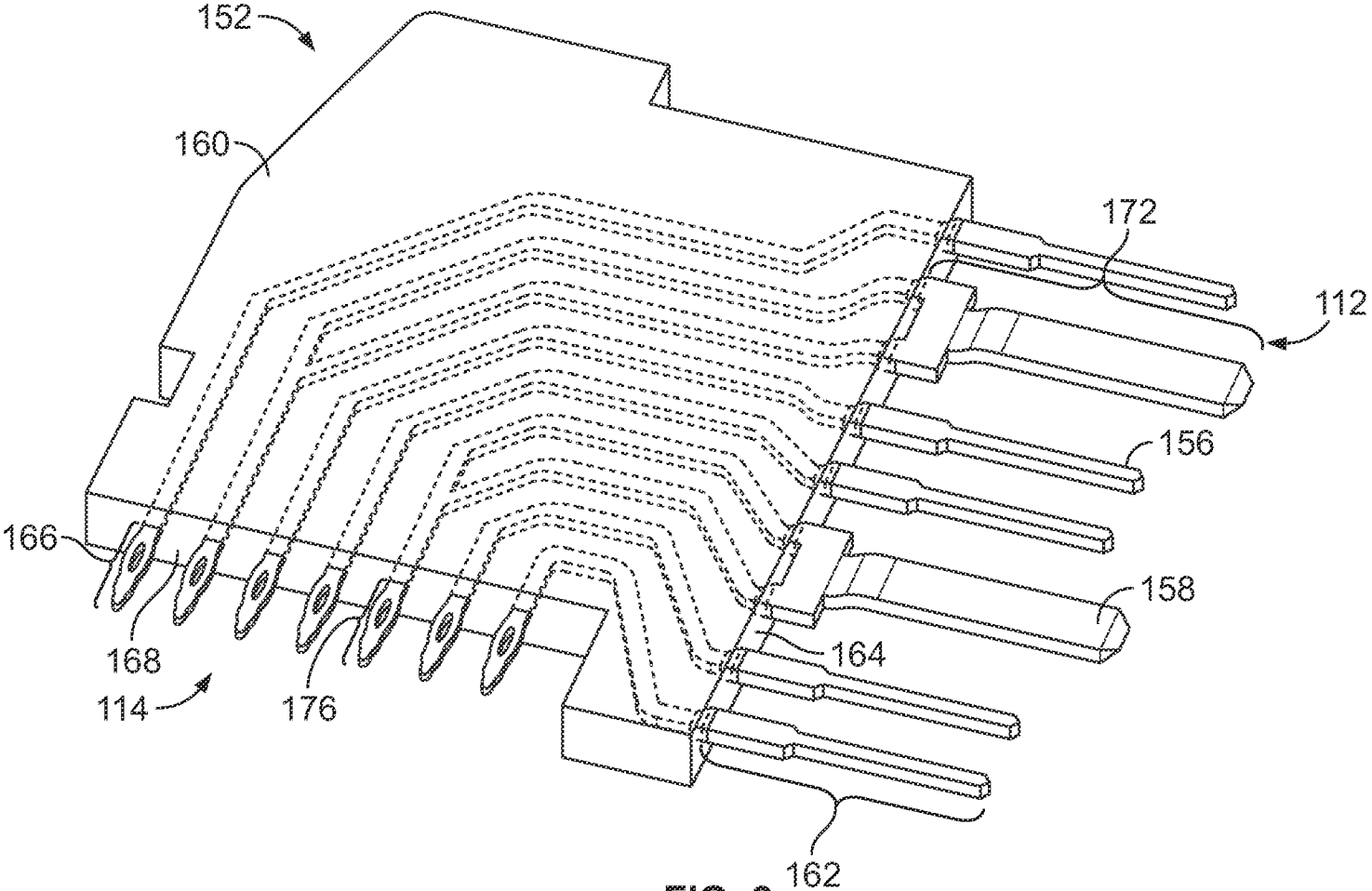
FIG. 2 is a front perspective view of a contact module for a daughtercard connector of the electrical connector system shown in FIG. 1.

FIG. 2 is a front perspective view of one of the contact modules 152 formed in accordance with an exemplary embodiment. The mating contacts 156 and ground contacts 158 are shown extending from the mating interface 112 and the mounting interface 114. In an exemplary embodiment the contact module 152 includes a dielectric body 160 holding the mating contacts 156 and ground contacts 158. In an exemplary embodiment, the dielectric body 160 is over molded over the mating contacts 156 and ground contacts 158. For example, the mating contacts 156 and the ground contacts 158 may be initially held together as part of a common lead frame that is over molded with a plastic material to form the dielectric body 160. The contact module 152 may be manufactured by other methods or processes in alternative embodiments.

At the mating interface 112, the mating contacts 156 have mating portions 162 extending forward from a front edge 164 of the dielectric body 160. In the illustrated embodiment, the mating portions 162 constitute pins that are configure to be mated with corresponding signal contacts 126 (shown in FIG. 3). The mating portions 162 may be other types of contacts in alternative embodiments, including sockets, spring beams, or other types of contacts.

At the mounting interface 114 the mating contacts 156 including mounting portions 166 extending from a bottom edge 168 of the dielectric body 160. In the illustrated embodiment, the mounting portions 166 constitute compliant pins, such as eye of the needle contacts, configured to be inserted into the daughter card circuit board 108 (shown in FIG. 1). Other type of contacts may be provided to define the mounting portions 166 for terminating the mating contacts 156 to the daughter card circuit board 108. For example, surface mounting tails may be provided to surface mount the mating contacts 156 to the daughter card circuit board 108.

At the mating interface 112, the ground contacts 158 have mating portions 172 extending forward from the front edge 164 of the dielectric body 160. In the illustrated embodiment, the mating portions 172 constitute spring beams that are configure to be mated with corresponding shield plates 128 (shown in FIG. 3). The spring beams may be deflected and spring biased against the shield plates 128 when mated thereto. The mating portions 172 may be other types of contacts in alternative embodiments, including pins, sockets, blades, or other types of contacts.

At the mounting interface 114 the ground contacts 158 including mounting portions 176 extending from the bottom edge 168 of the dielectric body 160. In the illustrated embodiment, the mounting portions 176 constitute compliant pins, such as eye of the needle contacts, configured to be inserted into the daughter card circuit board 108 (shown in FIG. 1). Other type of contacts may be provided to define the mounting portions 176 for terminating the ground contacts 158 to the daughter card circuit board 108. For example, surface mounting tails may be provided to surface mount the ground contacts 158 to the daughter card circuit board 108.

Figure 3:
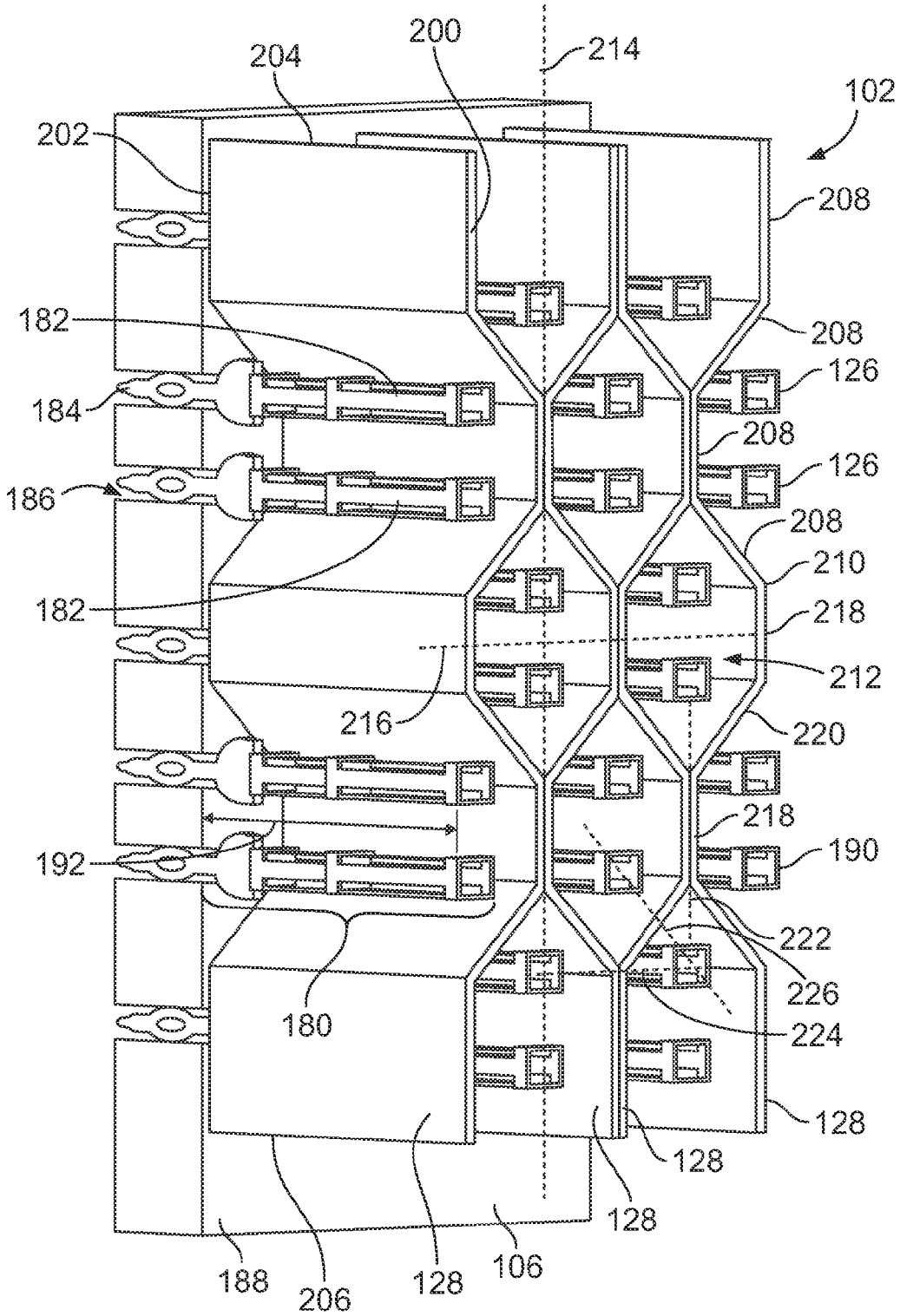
FIG. 3 is a front perspective view of a portion of a backplane connector of the electrical connector system shown in FIG. 1.

FIG. 3 is a front perspective view of a portion of the backplane connector 102 coupled to the backplane circuit board 106 with the housing 120 removed to illustrate the signal contacts 126 and shield plates 128. The shield plates 128 entirely peripherally surround the pairs of signal contacts 126 to provide electrical shielding for the pairs of signal contacts 126.

The signal contacts 126 have mating portions 180 configured to be mated with corresponding mating contacts 156 (shown in FIG. 2). In the illustrated embodiment, the mating portions 180 constitute sockets configured to receive the mating contacts 156. The sockets are box-shaped to receive the mating contacts 156 therein. The mating portions 180 have spring fingers 182 that press against the mating contacts 156 when loaded therein. Other types of contacts may be provided in alternative embodiments other than sockets for mating with corresponding mating contacts 156. The signal contacts 126 including mounting portions 184 terminated to the backplane circuit board 106. In the illustrated embodiment, the mounting portions 184 constitute complaint pins, such as eye of the needle pins. Other types of contacts may be provided in alternative embodiments to define the mounting portions 184. The mounting portions 184 are received in vias 186 in the backplane circuit board 106 to electrically connect the signal contacts 126 to corresponding traces on the backplane circuit board 106. The signal contacts 126 extend from a first side 188 of the backplane circuit board 106 to a tip 190 distal from the first side 188. The tip 190 is located a length 192 from the first side 188. In an exemplary embodiment, the length 192 is short enough that the signal contacts 126 remain interior of corresponding signal channels 138 (shown in FIG. 1) of the housing 120 (shown in FIG. 1).

The shield plate 128 electrically shields pairs of signal contacts 126 from other pairs of signal contacts 126. The shield plate 128 extends between a front edge 200 and a rear edge 202. In an exemplary embodiment, the rear edge 202 abuts against the first side 188 of the backplane circuit board 106. The rear edge 202 is position proximate to the rear 124 (shown in FIG. 1) of the housing 120. The front edge 200 is configured to be proximate to the front 122 (shown in FIG. 1) of the housing 120. In an exemplary embodiment, the shield plates 128 remain interior of the housing 120.

The shield plates 128 are elongated between a first edge 204 and a second edge 206. In an exemplary embodiment, the shield plates 128 are non-planar. The shield plates 128 have a wavy configuration to pass between and along pairs of signal contacts 126. Optionally, the shield plates 128 may be located as far from the signal contacts 126 as possible. For example, the shield plates 128 may be shaped to be positioned generally equidistant from adjacent signal contacts 126.

In an exemplary embodiment, each shield plate 128 includes a plurality of walls 208 angled with respect to one another at lines of intersection 210. In alternative embodiments, the walls 208 may have curved transitions rather than angled transitions at the lines of intersection 210. In an exemplary embodiment, each shield plate 128 extends along multiple pairs of signal contacts 126. The shield plates 128 engage other shield plates 128 to electrically common the shield plates 128 together. In an exemplary embodiment, the shield plates 128 form cavities 212 around the pairs of signal contacts 126. The cavities 212 may have any shape depending on the shapes of the shield plates 128. In the illustrated embodiments, the cavities 212 are prism-shaped extending along the lengths 192 of the signal contacts 126 from the first side 188 of the backplane circuit board 106 to the front edge 200 of the shield plate 128. In the illustrated embodiment, the cavities 212 are hexagonal prism-shaped defined by six walls 208 of corresponding shield plates 128. For example, the cavities 212 may be formed by three walls 208 of one shield plate 128 and three walls 208 of an adjacent shield plate 128.

In an exemplary embodiment, the signal contacts 126 are arranged in columns along column axes 214 and in rows along row axes 216. The signal contacts 126 within each pair are aligned along the column axes 214. The walls 208 of the shield plates 128 include separating walls 218 between pairs of signal contacts 126 and transition walls 220 extending between separating walls 218. Some of the separating walls 218 are positioned between signal contacts 126 in different columns. Other separating walls 218 extend between pairs of signal contacts 126 in different rows. The transition walls 220 extend therebetween and extend between signal contacts 126 that are in different rows and in different columns. In an exemplary embodiment, column bi-sectors 222 are defined extending between signal contacts 126 within the same column. The separating walls 218 extend along and/or through the column bi-sectors 222. In an exemplary embodiment, row bisectors 224 are defined extending between signal contacts 126 within the same row. The separating walls 218 extend along and/or through the row bi-sectors 224. Linking bi-sectors 226 extend between nearest signal contacts 126 in different rows and in different columns. The transition walls 220 extend along and/or through the linking bi-sectors 226. In an exemplary embodiment, the transition walls 220 extend generally perpendicular with respect to the linking bi-sectors 226. In an exemplary embodiment, the separating walls 218 extend generally perpendicular to the row bi-sectors 224. In an exemplary embodiment, the separating walls 218 extend generally parallel to the column bi-sectors 222.

In an exemplary embodiment, within the backplane connector 102, the separating walls 218 of one shield plate 128 extend along, and abut against, corresponding separating walls 218 of an adjacent shield plate 128. The transition walls 220 of a given shield plate 128 generally extend between a separating wall 218 of a shield plate 128 to the left thereof and a separating wall 218 of a shield plate 128 to the right thereof.

Figure 4:
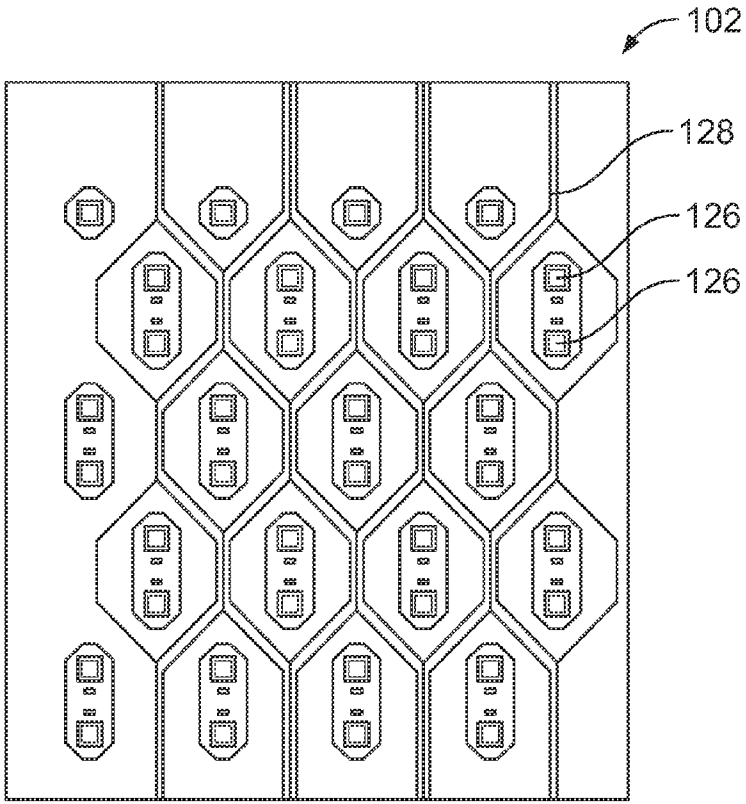
FIG. 4 is a front view of a portion of the backplane connector shown in FIG. 3.

FIG. 4 is a front view of the backplane connector 102 with the housing 120 (shown in FIG. 1) removed to illustrate the layout of the signal contacts 126 and shield plates 128. The pairs of signal contacts 126 are entirely peripherally surrounded by the shield plates 128. No gaps or spaces, which could allow EMI leakage between pairs of signal contacts 126, are provided through or between the shield plates 128.

Figure 5:
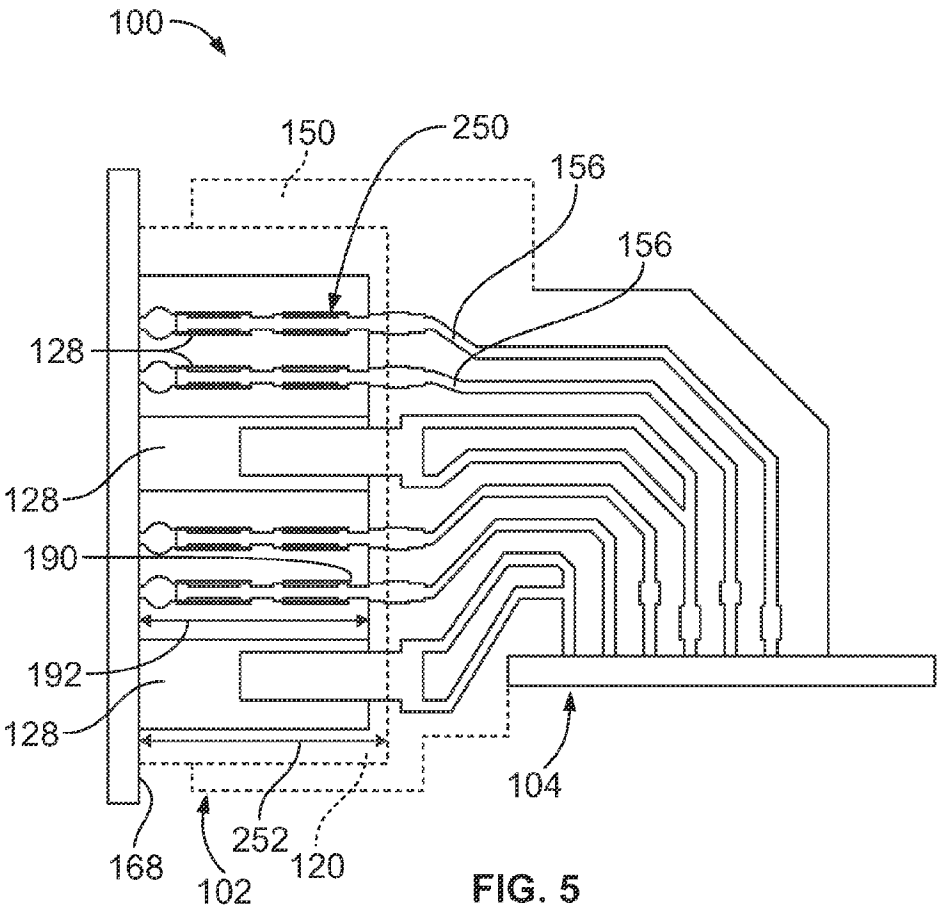
FIG. 5 is a side view of a portion of the electrical connector system.

FIG. 5 is a side view of the electrical connector system 100 showing the electrical path through the backplane and daughter card connectors 102, 104. The housing 120 and the housing 150 (both shown in phantom) are removed to illustrate the signal contacts 126 and the mating contacts 156. The signal contacts 126 receive the ends of the mating contacts 156 therein. A mating interface, generally identified at numeral 250, is defined along a portion of the mating contacts 156 received in the signal contacts 126.

The signal contacts 126 extend the length 192 from the first side 188. In an exemplary embodiment, the shield plates 128 extend from the first side 188 a distance 252 generally beyond the tips 190 of the signal contacts 126. The distance 252 is at least as long as the length 192 of the signal contacts 126 measured from the first side 188 to provide electrical shielding along the entire length of the signal contacts 126. The shield plates 128 provide shielding for portions of the mating contacts 156, such as those portions of the mating contacts 156 at the mating interface 250.

Figure 6:
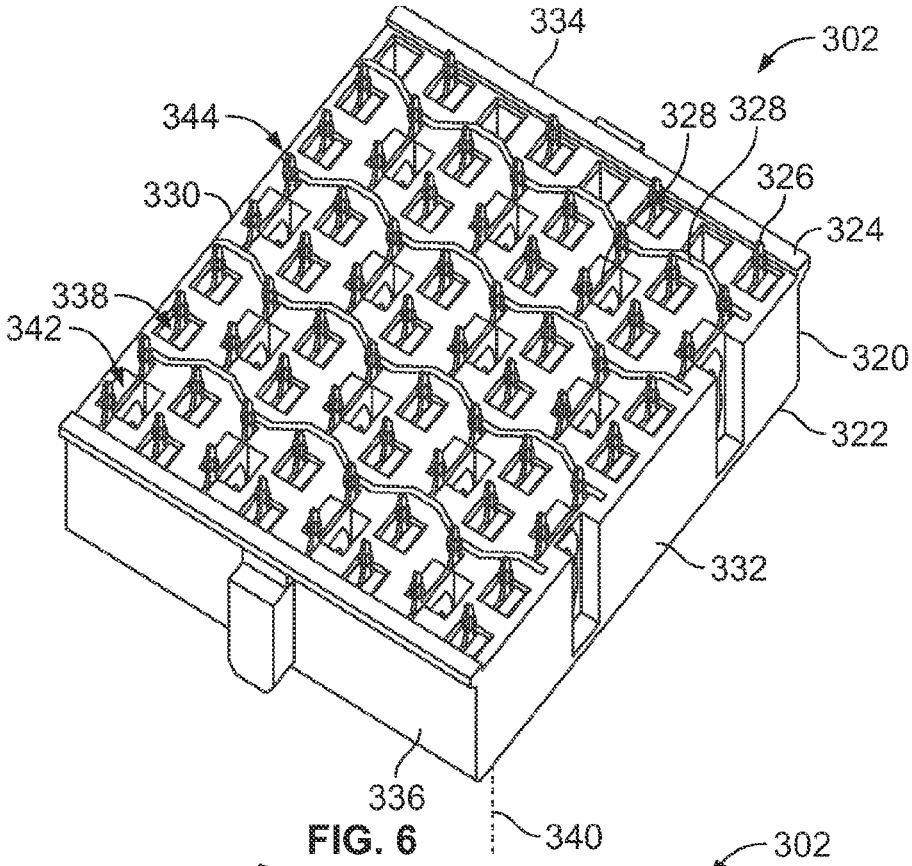
FIG. 6 is a front perspective view of a backplane connector formed in accordance with an exemplary embodiment.
Figure 7:
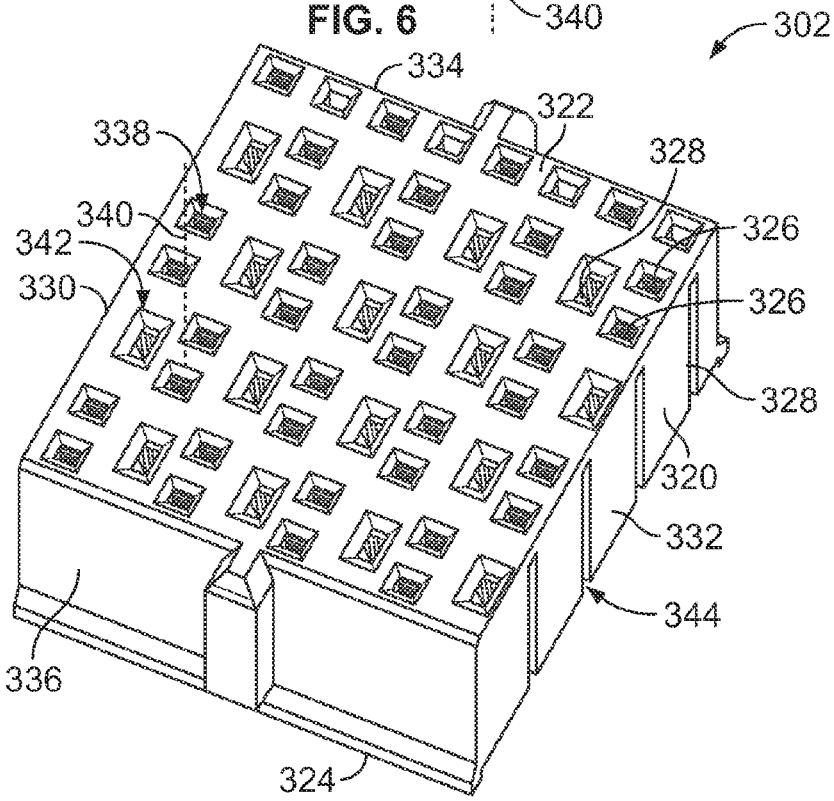
FIG. 7 is a rear perspective view of the backplane connector.

FIGS. 6 and 7 are front and rear perspective views of a backplane connector 302 formed in accordance with an exemplary embodiment. The backplane connector 302 may be used in place of the backplane connector 102 (shown in FIG. 1) within the electrical connector system 100 (shown in FIG. 1).

The backplane connector 302 includes a housing 320. The housing 320 has a mating end 322, also referred to herein as a front 322, that is loaded into the chamber 110 (shown in FIG. 1) during mating. The housing 320 has a mounting end 324, also referred to herein as a rear 324, which is mounted to the backplane circuit board 106 (shown in FIG. 1). The housing 320 holds a plurality of individual signal contacts 326 that extend between the front 322 and the rear 324. In an exemplary embodiment, the signal contacts 326 are arranged in pairs carrying differential signals. The housing 320 holds a plurality of shield plates 328 (shown in more detail in FIG. 8) that extend between the front 322 and the rear 324. The housing 320 includes opposite first and second sides 330, 332 and opposite first and second ends 334, 336.

The housing 320 includes a plurality of signal channels 338 extending between the front 322 and the rear 324. The signal channels 338 extend along mating axes 340 and receive the signal contacts 326. When the backplane connector 302 and daughtercard connector 104 are mated, mating contacts 156 (shown in FIG. 1) of the daughtercard connector 104 are also received in the signal channels 338.

The housing 320 includes slots 344 that receive the shield plates 328. The slots 344 are sized and shaped to receive the shield plates 328. The slots 344 are open at the rear 324. The housing 320 includes a plurality of ground channels 342 extending between the front 322 and the rear 324. The ground channels 342 are open to the slots 344. The ground channels 342 are open at the front 322 to receive the ground contacts 158 (shown in FIG. 1) of the daughtercard connector 104. The ground channels 342 and signal channels 338 are aligned in rows and in columns. The columns may be generally parallel to the sides 330, 332 and the rows may be generally perpendicular to the sides 330, 332.

As described in further detail below, the shield plates 328 entirely peripherally surround the pairs of signal contacts 326 to provide electrical shielding for the pairs of signal contacts 326. In an exemplary embodiment, entire, 360° shielding is provided by the shield plates 328 along the length of the signal contacts 326. The shield plates 328 may control electrical characteristics of the signal paths of the signal contacts 326, such as by controlling cross talk, signal radiation or other electrical characteristics.

Figure 8:
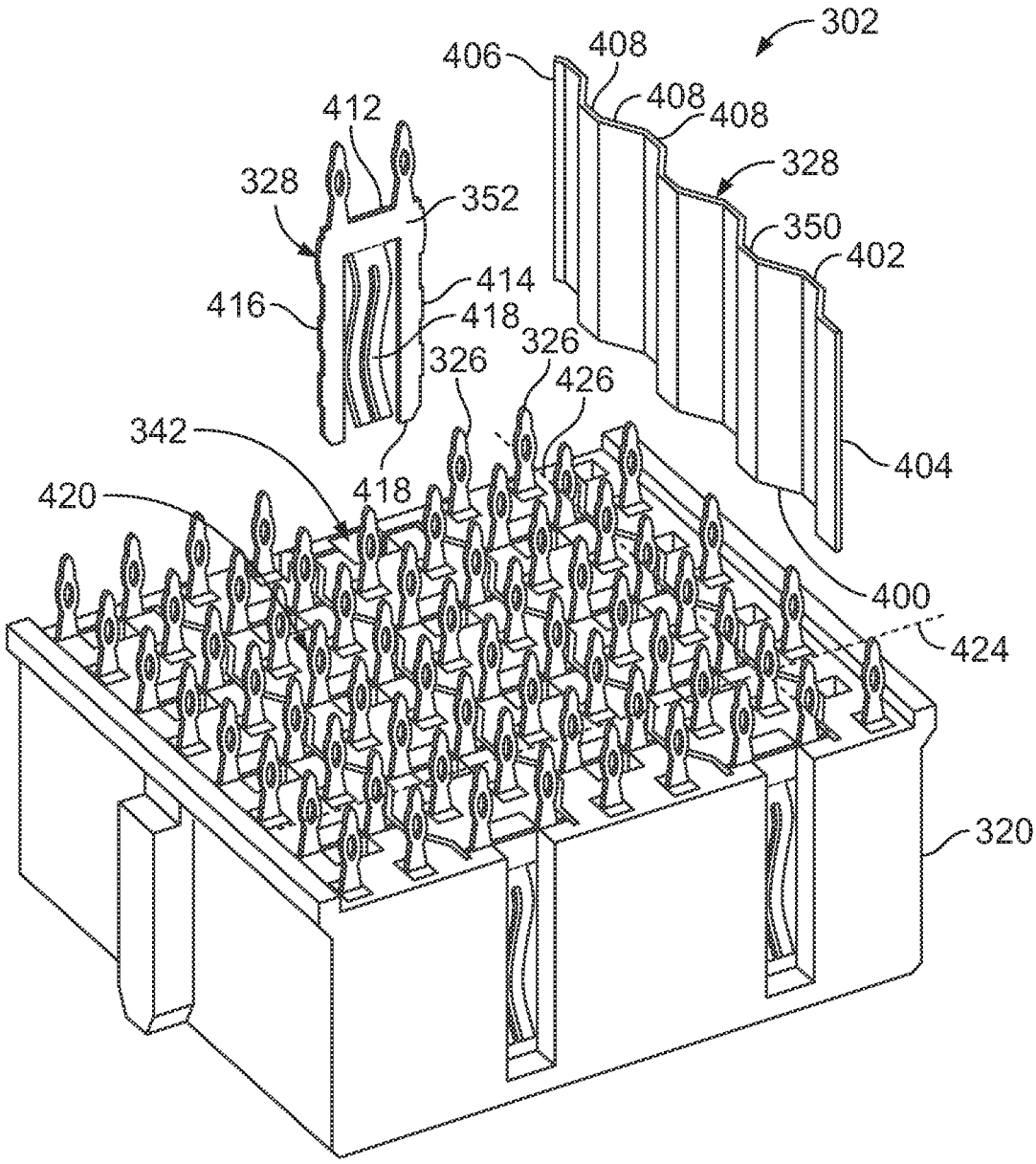
FIG. 8 is a rear perspective view of the backplane connector.

FIG. 8 is a rear perspective view of the backplane connector 302 illustrating some of the shield plates 328 poised for loading into the housing 320. The shield plates 328 entirely peripherally surround the pairs of signal contacts 326 to provide electrical shielding for the pairs of signal contacts 326. The shield plates 328 electrically shield pairs of signal contacts 326 from other pairs of signal contacts 326.

In an exemplary embodiment, the backplane connector 302 includes different types of shield plates 328 that are connected together to form shielded pockets or cavities for the pairs of signal contacts 326. For example, in the illustrated embodiment, the backplane connector 302 includes primary shield plates 350 and secondary shield plates 352. The secondary shield plates 352 extend between, and electrically connect, two primary shield plates 350.

Each primary shield plate 350 extends between a front edge 400 and a rear edge 402. In an exemplary embodiment, the rear edge 402 may abut against the backplane circuit board 106 (shown in FIG. 1). The primary shield plates 350 are elongated between a first edge 404 and a second edge 406. In an exemplary embodiment, the primary shield plates 350 are non-planar. The primary shield plates 350 have a wavy configuration to pass between and along multiple pairs of signal contacts 326.

In an exemplary embodiment, each primary shield plate 350 includes a plurality of walls 408 angled with respect to one another. In alternative embodiments, the walls 408 may have curved transitions rather than angled transitions. In an exemplary embodiment, each primary shield plate 350 extends along multiple pairs of signal contacts 326.

Each secondary shield plate 352 extends between a front edge 410 and a rear edge 412. In an exemplary embodiment, the rear edge 412 may abut against the backplane circuit board 106. The secondary shield plate 352 is elongated between a first edge 414 and a second edge 416. In an exemplary embodiment, the secondary shield plate 352 is generally planar, for example along the legs at the first and second edges 414, 416. The secondary shield plate 352 has a spring beam 418 having a curved shape. The spring beams 418 are received in corresponding ground channels 342 (shown in FIG. 6). The spring beams 418 are designed to be biased against the ground contacts 158 (shown in FIG. 1) to ensure electrical contact between the shield plates 328 and the ground contacts 158.

The secondary shield plates 352 are positioned between, and engage, the primary shield plates 350 to electrically common the primary shield plates 350 together. The first and second edges 414, 416 are pressed against corresponding walls 408 of the primary shield plates 350. In an exemplary embodiment, the shield plates 328 form cavities 420 around the pairs of signal contacts 326. The cavities 420 may have any shape depending on the shapes of the shield plates 328. In the illustrated embodiments, the cavities 420 are prism-shaped extending along the signal contacts 326. In the illustrated embodiment, the cavities 420 are octagonal prism-shaped defined by three walls 408 of one primary shield plates 350, one secondary shield plate 352, three walls 408 of another primary shield plates 350, and another secondary shield plate 352.

In an exemplary embodiment, the signal contacts 326 are arranged in columns along column axes 424 and in rows along row axes 426. The signal contacts 326 within each pair are aligned along the column axes 424. The primary shield plates 350 generally extend parallel to the row axes 426. The primary shield plates 350 extend between pairs of signal contacts 326 within the same column. The secondary shield plates 352 generally extend parallel to the column axes 424. The secondary shield plates 352 extend between pairs of signal contacts 326 in different columns. Optionally, the secondary shield plates 352 may be aligned, in-column, with some signal contacts 326 and in-row with other signal contacts 326.

The pairs of signal contacts 326 are entirely peripherally surrounded by the shield plates 328. No gaps or spaces, which could allow EMI leakage between pairs of signal contacts 326, are provided through or between the shield plates 328.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector system comprising:

a backplane connector comprising a housing, signal contacts held by the housing and shield plates held by the housing;

the housing includes a front and a rear, the housing includes signal channels extending along mating axes thereof between the front and the rear, the signal channels receive corresponding signal contacts, the housing includes slots that receive the shield plates;

the signal contacts extend along the mating axes, the signal contacts are arranged in pairs carrying differential signals, pairs of signal contacts being arranged in columns along column axes perpendicular to the mating axes;

the shield plates are electrically conductive, the shield plates extend generally parallel to the mating axes between corresponding pairs of signal contacts to entirely peripherally surround the pairs of signal contacts to provide electrical shielding for the pairs of signal contacts, the shield plates having separating walls aligned between pairs of the signal contacts and transition walls extending between separating walls, the separating walls being parallel to the column axes, the transition walls being angled non-orthogonal to the separating walls.

2. The electrical connector system of claim 1, wherein the signal contacts extends lengths within the signal channels, the shield plates entirely surrounding the pairs of signal contacts along the entire lengths of the signal contacts.

3. The electrical connector system of claim 1, wherein the shield plates have a front edge and a rear edge, the front edge being proximate the front of the housing, the rear edge being proximate the rear of the housing.

4. The electrical connector system of claim 1, wherein the shield plates form prism shaped cavities entirely peripherally surrounding corresponding pairs of signal contacts.

5. The electrical connector system of claim 1, wherein each shield plate bounds more than one pair of signal contacts.

6. The electrical connector system of claim 1, wherein the shield plates are configured to engage at least two other shield plates.

7. The electrical connector system of claim 1, wherein the pairs of signal contacts are arranged in columns and rows, the pairs of signal contacts in adjacent columns being in different rows.

8. The electrical connector system of claim 7, wherein the shield plates are oriented along column bi-sectors extending between signal contacts within the same column, along row bisectors extending between signal contacts within the same row, and along linking bisectors extending between nearest signal contacts in different rows and different columns.

9. The electrical connector system of claim 1 further comprising a backplane circuit board, the backplane connector being mounting to the backplane circuit board, the signal contacts being terminated to the backplane circuit board and extending from a first side of the backplane circuit board, the shield plates being terminated to the backplane circuit board and extending from the first side of the backplane circuit board, the shield plates extending a distance from the first side, the distance being at least as long as a length of the signal contacts measured from the first side.

10. The electrical connector system of claim 1, wherein the housing includes opposite first and second sides and opposite first and second ends extending between the front and the rear of the housing, the shield plates having a wavy configuration between first and second edges, the first edge being positioned proximate to the first side or the first end, the second edge being positioned proximate to the second side or the second end, the shield plates passing along at least two pairs of signal contacts.

11. The electrical connector system of claim 1, wherein the shield plates comprise primary shield plates and secondary shield plates, the primary shields plates being elongated, having a wavy configuration, and extending along at least two pairs of signal contacts, the secondary shields plates positioned between and electrically connecting adjacent primary shield plates.

12. The electrical connector system of claim 11, wherein the pairs of signal contacts are surrounded by two primary shield plates and two secondary shield plates.

13. An electrical connector system comprising:

a backplane connector comprising a housing, signal contacts held by the housing and shield plates held by the housing;

the housing includes a front and a rear, the housing includes opposite first and second sides extending between the front and the rear;

the signal contacts are arranged in pairs carrying differential signals, the pairs of signal contacts are arranged in columns parallel to the first and second sides;

the shield plates are electrically conductive, the shield plates have a plurality of separating walls and a plurality of transition walls between corresponding separating walls, the transition walls being angled at acute angles relative to the separating walls, the separating walls and transition walls having a wavy configuration between a first edge and a second edge, the shield plates extend between the first and second edges generally along the columns of the signal contacts such that the shield plates provide electrical shielding between pairs of the signal contacts, the shield plates are arranged in the housing such that the shield plates entirely peripherally surround the pairs of signal contacts to provide electrical shielding for the pairs of signal contacts.

14. The electrical connector system of claim 13, wherein the signal contacts extends lengths within the signal channels, the shield plates entirely surrounding the pairs of signal contacts along the entire lengths of the signal contacts.

15. The electrical connector system of claim 13, wherein the shield plates form prism shaped cavities entirely peripherally surrounding corresponding pairs of signal contacts.

16. The electrical connector system of claim 13, wherein the shield plates are configured to engage at least two other shield plates.

17. The electrical connector system of claim 13, wherein the pairs of signal contacts are arranged in columns and rows, the pairs of signal contacts in adjacent columns being in different rows, wherein the shield plates are oriented along column bi-sectors extending between signal contacts within the same column, along row bisectors extending between signal contacts within the same row, and along linking bisectors extending between nearest signal contacts in different rows and different columns.

18. The electrical connector system of claim 13, wherein the shield plates comprise primary shield plates and secondary shield plates, the primary shields plates being elongated, having a wavy configuration, and extending along at least two pairs of signal contacts, the secondary shields plates positioned between and electrically connecting adjacent primary shield plates.

19. An electrical connector system comprising:

a backplane connector comprising a housing, signal contacts held by the housing and shield plates held by the housing;

the housing includes a front and a rear, the housing includes opposite first and second sides extending between the front and the rear;

the signal contacts are arranged in pairs carrying differential signals, the pairs of signal contacts are arranged in columns generally parallel to the first and second sides, the pairs of signal contacts are arranged in rows generally perpendicular to the first and second sides;

the shield plates are electrically conductive, the shield plates extend between columns of the pairs of signal contacts and the shield plates extend between rows of the pairs of signal contacts with walls that form prism shaped cavities that entirely peripherally surround the pairs of signal contacts to provide electrical shielding for the pairs of signal contacts, the prism shaped cavities being formed by more than four walls of corresponding shield plates.

20. The electrical connector system of claim 19, wherein at least some of the walls of the shield plates forming the prism shaped cavities are angled at acute angles relative to adjacent walls.

* * * * *